United States Patent [19]

Bryant et al.

[11] Patent Number: 4,935,984

[45] Date of Patent: Jun. 26, 1990

[54] VACUUM REFUSE COLLECTING VEHICLE

[75] Inventors: Earl R. Bryant; E. Nelson Hutcheson; W. Marlin Franklin, all of Birmingham, Ala.

[73] Assignee: Guzzler Manufactureing, Inc., Birmingham, Ala.

[21] Appl. No.: 308,045

[22] Filed: Feb. 9, 1989

[51] Int. Cl.[5] ..... B08B 3/02

[52] U.S. Cl. ..... 15/302; 15/315; 15/340.1; 134/167 C; 134/168 C

[58] Field of Search ..... 15/302, 340.1, 315, 15/320; 134/168 C, 167 C

[56] References Cited

U.S. PATENT DOCUMENTS

| | | | |
|---|---|---|---|
| 2,913,744 | 11/1959 | Gregersen | 15/340.3 X |
| 3,011,206 | 12/1961 | Breither | 15/320 |
| 3,512,206 | 5/1970 | Young | 15/340.1 X |
| 3,541,631 | 11/1970 | Kluge et al. | 15/340 |
| 3,780,502 | 12/1973 | Dupre et al. | 55/337 |
| 4,111,670 | 11/1979 | DeMarco | 55/315 |
| 4,134,174 | 1/1979 | Flynn et al. | 15/302 |
| 4,160,302 | 7/1979 | Hirst et al. | 15/340.1 |
| 4,199,837 | 4/1980 | Fisco | 15/302 |
| 4,207,647 | 6/1980 | Masters | 15/302 |
| 4,218,226 | 8/1980 | Boozer | 55/274 |
| 4,227,893 | 10/1980 | Shaddock | 55/97 |
| 4,234,980 | 9/1978 | DiVito et al. | 15/302 |
| 4,484,606 | 11/1984 | Kosters | 141/114 |
| 4,574,420 | 3/1986 | Dupre | 15/331 |
| 4,578,840 | 4/1986 | Pausch | 15/340 |
| 4,723,969 | 2/1988 | DeMarco | 55/97 |
| 4,820,315 | 4/1989 | DeMarco | 55/1 |

FOREIGN PATENT DOCUMENTS 2167682A 6/1986 United Kingdom .

*Primary Examiner*—Chris K. Moore
*Attorney, Agent, or Firm*—Thomas & Kennedy

[57] ABSTRACT

A vacuum refuse collecting vehicle has a tank divided into two hermetically sealed compartments by an internal sloped wall. The forward compartment functions as a water tank and the rear compartment as a waste containment tank. The capacity of the compartments can be increased by the addition of spacers to the cylindrical tank to make the tank longer, by changing the angle of the internal sloped wall, or by changing the depth of the concave end walls of the tank. The rear compartment is equipped with an upwardly tilting hinged concave tail gate for emptying the waste therefrom. The airstream which deposits the waste material in the tank is directed out of the tank into one or more bag filter housings, through an air pump, a silencer, and then to the surrounding atmosphere. The bag filters are so mounted and constructed that they may be removed through the bottom of the housings, thereby maintaining the upper portions of the housings substantially free of waste material.

21 Claims, 5 Drawing Sheets

VACUUM REFUSE COLLECTING VEHICLE

BACKGROUND OF THE INVENTION

This invention relates to a vehicle mounted refuse collection apparatus and, more particularly, to a vacuum type collector apparatus especially adapted for use in cleaning out sewers, sludge basins, and the like in which both particulate matter and liquids are present.

For cleaning out sewers, for example, it has proven efficient to have both a collecting or vacuum apparatus and a refuse storage tank combined on a single vehicle and adapted to be transported to the clean-up site, and after clean-up to be transported to a suitable waste disposal site. Examples of such arrangements are disclosed in U.S. Pat. Nos. 4,111,670 of DeMarco, 4,227,893 of Shaddock, 4,199,837 of Fisco, Jr., 4,234,980 of DiVito et al, and 4,160,302 of Hirst et al.

For the heavy duty cleaning out of sewers and the like, it has been found desirable to inject water under pressure into the sewer or element to be cleaned out and the water transports the refuse from the sewer to the storage tank. In most cases the water can be separated from the refuse and discharged from the storage tank to the sewer. To insure an adequate supply of water at the job site, it is desirable to include along with the refuse collecting unit and storage tank a water tank of sufficient capacity. The water tank can be mounted on the vehicle together with a pump and other suitable apparatus for introducing the water from the water tank into the sewer or element to be cleaned. Examples of various arrangements for accomplishing this are shown in the aforementioned Fisco, Jr., DiVito et al, and Hirst et al patents, as well as in U.S. Pat. Nos. 4,207,647 of Masters and 4,322,868 of Wurster.

In the known prior art arrangements, the vehicle is driven to the site where clean-up is to take place, one end of a vacuum hose carried by the vehicle on a boom arrangement is lowered into the sewer and the refuse is vacuumed up through the hose and into the refuse storage tank. Various arrangements are provided within the refuse storage tank for separating the refuse from the air stream so that the tank becomes filled with the refuse and the air is discharged to the atmosphere. When loaded with refuse, the vehicle is transported to a suitable waste deposit site and the entire tank is tilted to empty it. Where water is used to facilitate the cleaning process, means generally are provided to separate the water from the refuse, which allows dumping the water back into the sewer.

All of such systems have shortcomings. For example, the tilting of a refuse laden carrier requires expensive heavy duty tilting mechanisms for raising the front of the refuse storage chamber and which create an electrical shock hazard when in the vicinity of overhead power lines. Where the vehicle is equipped with a water tank, not only is an additional complication produced in the tilting operation, but a problem of weight distribution is presented. In most cases where tilting is used to empty the refuse storage tank, it is necessary to uncouple the hoses or conduits connected to the tank before the refuse tank is tilted.

The weight distribution problem created by the addition of a water storage tank can best be appreciated by an example. Where the water storage tank is mounted in front of the refuse storage tank, as the vehicle is being driven to the collection site, the greatest percentage of the load carried by the vehicle is due to a full water tank, while the refuse tank is empty. This places a higher percentage of the vehicle weight on the front wheels and tends to overload the front wheels. After the clean-up, the opposite situation prevails, since the water tank is now virtually empty and the refuse tank is full, thereby placing the greatest portion of the weight over the rear axle or axles of the vehicle. If the water tank is either above or below the refuse tank, there likely is produced a top-heavy condition, either en route to the site, or en route to the waste dump, which can be dangerous while the vehicle is moving.

In the vacuum process, an air pump is used to create the vacuum, and usually such pump is located at or near the discharge point of the air to the atmosphere. If particulate matter remains in the air stream after passage through the refuse collection tank, the particulate matter can damage or clog the pump, as well as be discharged into the surrounding atmosphere. In an effort to cleanse the discharge air, sometimes filters are use, in some cases comprising a multiplicity of filter bags contained in a housing located between the refuse tank and the air pump. Such an arrangement is shown, for example, in the Shaddock patent. A problem arises with such bags, however, in that they accumulate particulate matter and commence to impede the air flow after a time, thus it is necessary to clean and replace such bags. Replacement of the bags in accordance with prior art methods entails lifting the bags out of the housing, which results in the dislodging and deposit of some of the particulate matter in a region of the housing that is normally in the path of filtered air flow, with the net result that in operation, the discharged air may contain some remnants of the refuse which can damage the air pump.

The prior art vacuum refuse collection vehicles generally are unitary in nature, and, once designed, are limited to the sizes and capacities incorporated in the design specifications. The inflexibility of capacities of the design is likely to result in an arrangement of insufficient capacity for some applications, or of too much capacity for other applications or a mismatch of water storage capacity with refuse storage capacity for a particular job requirement.

It is therefore, an object of the present invention to eliminate the necessity of tilting the entire container assembly, thereby resulting in a relatively simple structure that does not require expensive tilting machinery and does not require disconnection of the various pipes and hoses from the refuse collection tank prior to tilting.

It is another object of the invention to provide a water storage tank on the refuse collection vehicle for carrying a supply of water along with the refuse collecting tank in such a manner that weight shifts and imbalances are minimized and the axial loading of the vehicle remains relatively constant as the water supply is depleted and the waste is collected.

Still another object of the invention is to provide a filter bag housing and bag mounting arrangement that reduces the likelihood of waste matter being deposited in the region of filtered air flow when the bags are removed for replacement or cleaning.

Another object of the present invention is to provide a semi-modular construction for a refuse collecting vehicle whose size and capacity can be customized for the particular use to which the vehicle is to be put.

SUMMARY OF THE INVENTION

These and other objects, features and advantages are realized in the present invention which comprises a vacuum refuse collecting vehicle which includes a waste receiving and transporting chamber and a water transporting chamber combined in a unitary cylindrical tank, with the longitudinal axis of the cylindrical tank extending along the length of the vehicle. A sloped dividing wall or septum extends from the top front of the tank interior to the rear bottom of the tank interior and divides the tank into two parts, the front portion forming the water chamber and the rear front portion forming the water chamber and the rear portion the refuse containing chamber. Because of the sloped dividing wall in the tank the weight distribution of the water and refuse in the tank does not shift significantly in a longitudinal direction as the water supply is decreased and the volume of refuse is increased, thereby insuring a relatively constant axial loading. Furthermore, the instability that might arise from a top heavy condition is minimized because the sloped wall tends to cause the heavier waste or refuse to move toward the lower portion of the tank.

The cylindrical tank is capped at each end by closure members, which in the preferred embodiment is clamshell shaped, the closure member adjacent the rear of the tank being hinged at the top of the tank and tiltable upwardly for emptying the refuse from the tank. The dividing wall has a slope of from approximately 37° to 52° from front to rear, and the dividing wall is made of a material such as plastic, mild steel or stainless steel down which the refuse slides toward the rear. Thus, when the rear clamshell enclosure member is tilted upward, the refuse slides down the sloped wall and out of the tank, emptying the tank and the refuse in the clamshell closure member drops downwardly out of the closure member.

Where greater capacity is required, either for more water or more refuse, cylindrical spacer members can be inserted in the cylindrical wall of the and so as to lengthen the tank, deeper or shallower clamshells can be used at the ends of the tank, and the slope of the dividing wall can be changed.

A suction conduit is mounted on a movable boom above the and with one end in communication with the refuse collection chamber of the tank and the other end mounted on a boom. A flexible section of the suction conduit permits movement of the conduit laterally and vertically. Additional lengths of conduit are carried on a rack mounted on the vehicle so that the boom carried conduit may be lengthened for insertion into deep sewer mains. The conduit extends downwardly at one end of the vehicle for insertion into the area to be cleaned.

Mounted on the vehicle is a water hose reel and hose which is supplied with water from the water tank through a suitable water pump. The end of the hose to be inserted into the sewer has mounted thereon a nozzle with backwardly oriented jet openings so that the water moving through the jet openings tends to drive the nozzle forward while, at the same time liquefying or softening the waste in the sewer. The hose and reel can be mounted on either the front or the rear of the vehicle.

A vacuum pump causes the end of the conduit within the sewer to function as a vacuum cleaner, sucking up the refuse and sludge loosened up with the aid of the water jets. The waste material, liquid and air pass through the suction conduit into the refuse storage tank and in some models through a cyclone separator which separates the refuse from the air stream. An exhaust conduit leads from the refuse collection chamber at the top of the tank to the bottom of one or more bag filter housings and the exhaust air flow is further cleared of waste matter as it passes upward through the filter bags. At the top of one of the bag filter housings the air stream is directed downward through a steel microstrainer into a conduit leading into the vacuum pump, from which it is directed into a silencer and then into the atmosphere.

Each of the filter bags is retained in place by a spring steel band sewn in the cuff at the upper end portion of the bag which holds the cuff in place in an opening formed in a tube support sheet at the top of its housing, and the bags are prevented from collapsing by a metallic framework inserted in each bag. When the bags become dirty or clogged, the bag framework is removed and the bags are dropped down through the holes in the tube support sheet. Access doors at the bottom of the bag housing or housings permit access to the lower portions of the bags, and also permit cleaning of the accumulation of waste in the bottom of the housing caused by reverse air flow pulsing through the bags to maintain the bags in a clean condition.

BRIEF DESCRIPTION OF THE DRAWINGS

These and other features of the present invention will be more readily apparent from the following detailed description, read in conjunction with the accompanying drawings, in which.

DETAILED DESCRIPTION

Figure 1:
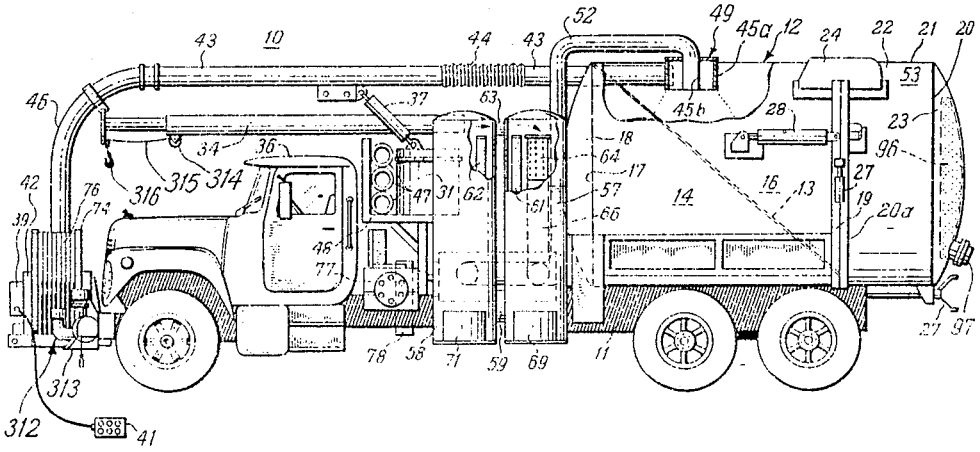
FIG. 1 is a side elevation, partially cutaway view of a vehicle embodying the principles of the present invention.
Figure 2:
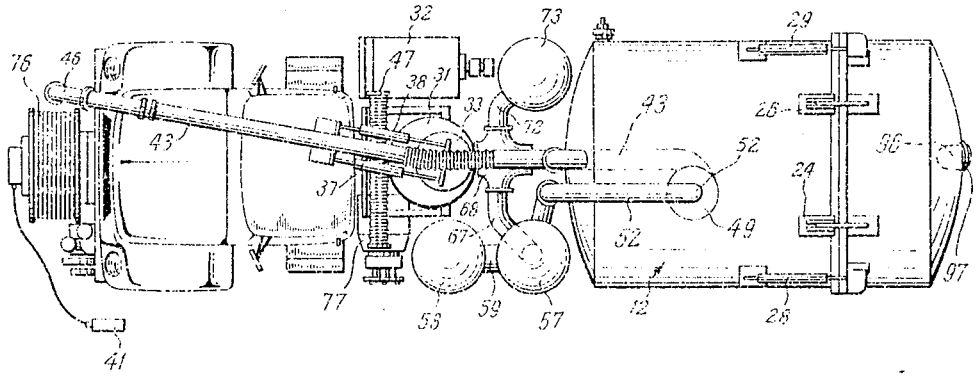
FIG. 2 is a plan view of the vehicle of FIG. 1.

Referring now in more detail to the drawings, in which like numerals indicate like features throughout the several figures, FIGS. 1 and 2 depict a vacuum refuse collecting vehicle 10 embodying the principles of the present invention. As shown in FIGS. 1 and 2 vehicle 10 comprises a ten-wheel double rear axle truck chassis and cab 11 upon which is mounted and affixed thereto a cylindrical tank member 12 of suitable material such as, for example, steel, approximately seven to eight feet in diameter. The length of tank 12 is chosen to provide sufficient capacity for the anticipated use. For example, for large capacity work the tank may be approximately nine and one-half feet in length, whereas for smaller capacity it may be six and one-half feet in length. Within tank 12 and extending from the top front edge of the tank to the bottom rear edge thereof is a sloping septum or divider wall 13 preferably of mild or carbon steel or stainless steel, which has the property of presenting a small amount of friction to objects sliding down its sloped upper surface. While other materials can be used, it is important that the divider wall 13 have a low coefficient of friction so the refuse easily moves down its upper surface. Divider wall 13 is welded in place to produce two separate, non-communicating compartments 14 and 16 within the tank 12. Inasmuch as divider wall 13 extends from the top front edge of tank 12 to the bottom rear edge thereof, its angle of slope is likely to vary with the length of tank 12. Thus for the long tank, the slope is at least 37°, while for a shorter tank the slope is steeper, for example, 52°. As will be apparent hereinafter, a change in the slope of the divider wall changes the capacities of the compartments 14 and 16, and the slope should be steep enough to assure the downward movement of the refuse in the refuse compartment 16.

The front end 17 of tank 12 is sealed by a convex or clamshell-shaped end wall 18 which is fixed in place, while in the embodiment shown in FIG. 1, the rear end 19 of tank 12 is sealed by a closure member or tail gate 21 comprising a cylindrical spacer member 22 and a convex or clamshell shaped end wall 23. As was pointed out in the foregoing, normally annular rim 19 of the tank is sealed to annular rim 20*a* of end wall 23. Where greater capacity is desired, spacer member 22 is inserted between end wall 23 and its rim 20 and is affixed to wall 23 as by welding or other suitable means which will provide a hermetic seal. In a similar manner, where greater capacity in water chamber 14 is desired, a spacer (not shown) may be added between end 17 of cylindrical tank 12 and end wall 18.

Closure member 21 is hinged to tank 12 by a pair of hinges 24 and 26 which are offset from the center line of tank 12, as best seen in FIG. 2, which reduces the overall height of the assembly and which stabilizes the door movement. In addition, a plurality of hydraulic latches 27 placed about the abutting rims 19 and 20*a* serve to clamp end closure member 21 securely to end of tank 12. A pair of hydraulic cylinder and piston assemblies 28 and 29 are connected between the outer wall of tank 12 and outer wall of closure member 21, near the top of the tank, as shown in FIGS. 1 and 2. When latches 27 are unlatched and hydraulic members 28 and 29 are actuated, closure member 21 is tilted upward from the bottom about the axis of hinges 24 and 26, thereby opening the assembly at the bottom of end 19 of tank 12, permitting the accumulated refuse in refuse chamber 16 and in the tilted end closure wall 23 to be dumped out. Sloped divider wall 13, preferably being of stainless steel, presents little friction to the refuse so that the refuse easily slides down the slope thereof and out the opening, thus emptying compartment 16 without the necessity of tilting tank 12.

For simplicity, the various hydraulic hoses and connections for hydraulic cylinder assemblies 27, 28 and 29 have not been shown in FIGS. 1 and 2. The hydraulic fluid is contained in hydraulic tank 31, and the hydraulic pressure is supplied by a motor and hydraulic pump assembly 32 mounted on the vehicle.

Mounted on top of hydraulic fluid storage tank 31 is a circular gear and bearing assembly 33 which has mounted thereon a boom 34 which extends out over the cab 36 of the vehicle 10. Boom 34 is moved and positioned by hydraulic cylinder and piston assemblies 37 and 38 which can move the boom 34 in azimuth, length and elevation to any desired position within the limits of travel of the pistons of assemblies 37 and 38. As was the case with hydraulic cylinder assemblies 28 and 29, the hydraulic connections to hydraulic cylinder assemblies 37 and 38 have not been shown for simplicity, but it is to be understood that they are controlled by hydraulic fluid from pump assembly 32. Pump assembly 32 is in turn controlled by an electrical control box 39 and actuator 41 which are attached to hose rack 42 on the front of the vehicle, the details of which will be discussed more fully hereinafter.

Vacuum conduit 43 communicates at one of its ends with cyclonic ring separator 49 at the top of tank 12 so that the refuse moving through the conduit 43 with air into refuse collection chamber 16 of the tank is separated from the high velocity air stream, allowing the refuse to fall into the tank compartment 16. The vacuum conduit 43 moves the refuse and fluid into the outer concentric space formed by outer wall 45*a* of the cyclonic ring and inner wall 45*b*, which causes a circular movement of the fluid and refuse, moving the heavier particles to the outside by centrifugal force. Exhaust conduit 52 extends concentrically up through the inner wall 45*b*, up through the tank 12 and then forwardly to the bag houses 57 and 58. Vacuum conduit 43 which extends from within the refuse collecting chamber 16 of tank 12 is mounted on top of boom 34 and projects beyond the end of boom 34. Because one end of conduit 43 is fixedly mounted to tank 12, it includes a flexible section 44 which enables it to move with boom 34 when the latter is placed in operative position. The free end 46 of conduit 43 is adapted to be inserted in a manhole or within the sewer to function as a vacuum cleaner. Additional lengths 47 of conduit are carried on a rack 48 and are readily attachable to the free end 46 of conduit 43 to increase its length as necessary.

Figure 3:
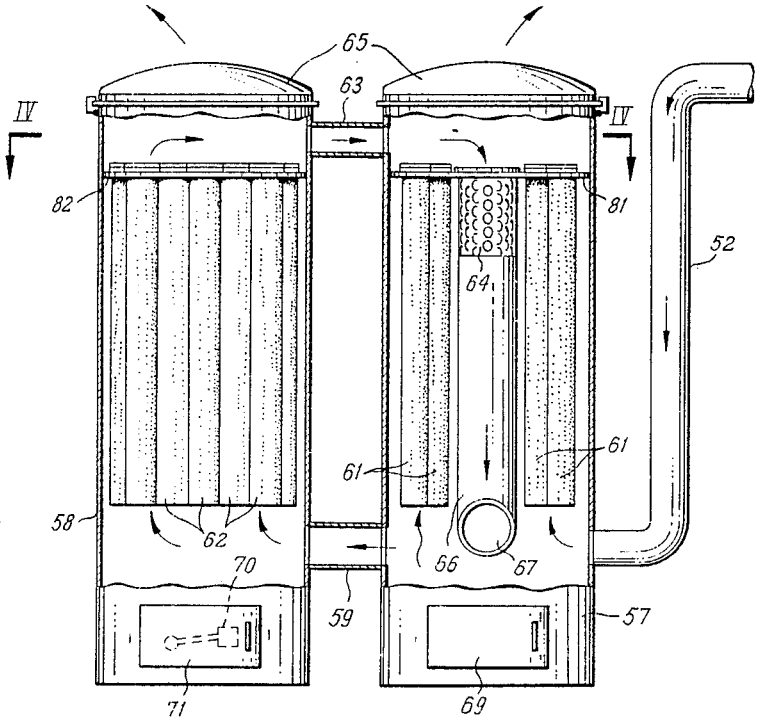
FIG. 3 is a cross-sectional elevation of the filter bag housings of the present invention.

Exhaust conduit 52 extends upwardly from the center of cyclonic ring separator 49 through the top of the tank 12 and turns at a right angle to extend forwardly of the vehicle, and then is turned downwardly in front of the tank to the lower portion of filter bag housing 57, into which the exhaust air stream is introduced (FIG. 3). A second filter bag housing 58 may be coupled to housing 57 by an air cross over passage 59. Second bag housing 58 is for use in higher volume air flow applications, and may be eliminated when desired. The exhaust air from conduit 52 passes upwardly through a plurality of filter bags 62 in housing 57, and upwardly through bags 62 in housing 58. The waste material is collected on the surfaces of the bags. Housing 58 is joined to housing 57 at the top by an air cross over duct 63 so that the filtered air from housing 58 mingles with the filtered air in housing 57 and all of the air then passes downward through a microstrainer 64 and duct 66 and exits from housing 57 into a duct 67 which leads to an air pump or blower 68 (FIG. 2). Blower 68 may be driven by the vehicle motor through suitable gearing, described hereinafter. The filter bag housings 57 and 58 are provided with clean-out doors 69 and 71. A level detector 70 (FIG. 3) is mounted in the lower portion of one of the filter bag housings and functions to deactivate the operation of the system upon detecting a high level accumulation of material in the bag house. In addition, a float shut off valve (not shown) can be used to close the air inlet 45b (FIG. 1) so that the rising level of liquid waste would automatically close the flow of fluid from tank 12 to bag house 57.

The exhaust air passes from air pump 68 through a duct 72 into the bottom of a silencer member 73 from which the air is discharged into the atmosphere.

Hose rack 42, which is mounted on the front of vehicle 10, carries a hose reel 74 rotatively mounted thereon and which contains a plurality of turns of high pressure water hose 76. In operation, the free end of hose 76 has mounted thereon a water jet driven nozzle, not shown, which is introduced into the sewer to supply a high velocity water stream for softening and at least partially liquefying the refuse, and also for washing out the sewer pipes. The water supply for hose 76 is contained in chamber 14 of the tank 12 and is pumped through water pump 77 to the hose 76. For simplicity, the connections between compartment 14 and pump 77, and between pump 77 and hose 76 have not been shown, it being understood that they are conventional in the art. A gear case 78 connected to water pump 77 is used to govern the velocity and pressure of the water, and may be driven by the vehicle motor or by auxiliary engine.

A hydraulically powered sludge pump 312 is removably mounted to a platform 313 mounted to the front of the vehicle. The sludge pump is used in conjunction with the vacuum collecting system when it is desired to clean thick liquid material such as mud which is normally too thick to be pulled into the system by the vacuum alone. A winch 314 having a cable 315 and a hook 316 is mounted to the boom 34. The winch 314 includes a motor and motor control valves (not shown) and is adapted to raise and lower the hook to the sludge pump 312 to which the hook 316 is attached. The sludge pump 312 can then be lifted by the winch and moved through articulation of the boom 34 to an operative location such as in a sludge pond. When in an operative position the sludge pump is coupled with the free end 46 of the conduit 43 and to the hydraulic pump 32 via hydraulic lines (not shown). When activated, the sludge pump acts to pump the mud or other sludge-like material into the conduit where it can be collected and processed by the system in the normal way.

Figure 4:
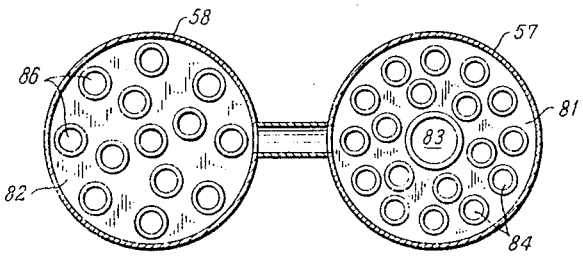
FIG. 4 is a cross-section along the line IV—IV in FIG. 3.

FIGS. 3 and 4 depict in greater detail the filter housing arrangement, including both filter housings 57 and 58, ducts 52 and 66, and ducts 59 and 63, and also show the directions of the air flow therethrough. Filter bags 61 and 62 are mounted in housings 57 and 58 respectively by means of tube support sheets 81 and 82 respectively, which are affixed to the interior walls of housings 57 and 58. As can be seen in FIG. 4, tube support sheet 81 has a central aperture 83 defining the top of duct 66 and into which is inserted microfilter 64. Radially disposed around aperture 83 are a plurality of apertures 84, into which filter bags 61 are fitted. Tube sheet 82 likewise has a plurality of apertures 86 for receiving bags 62, but does not have a central aperture.

Figure 5A:
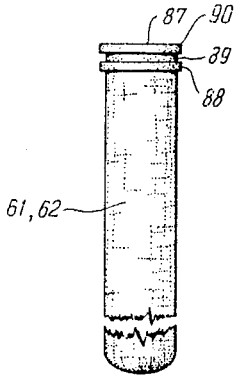
FIG. 5A is a view of a filter bag used in the housings of FIG. 3.
Figure 5B:
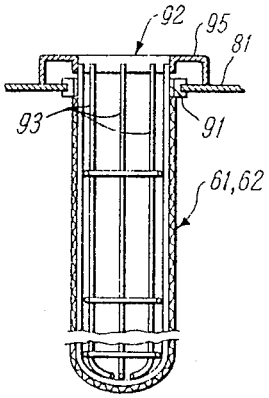
FIG. 5B is a view of a stiffener member for use with the filter bag of FIG. 5A.

Because of the force of the air passing through the housings 57 and 58, bags 61 and 62 ordinarily would tend to collapse and cease to function properly. In FIGS. 5A and 5B there is shown a preferred arrangement for preventing such collapse. The filter bags 61, 62 of FIG. 5A are formed of a suitable cloth filtering material, such as Dacron®, polypropylene, or polyethylene. The top of each bag is formed with a soft collar 90 with spaced annular flanges 87 and 88, leaving an annular groove 89 therebetween. A spring steel band 91 is positioned in the soft collar so that the collar tends to retain its circular shape but is collapsible when pressed inwardly. The collar is of greater diameter than its aperture 84 in the tube sheet 81, while the diameter of the groove 89 is slightly less than the diameter of one aperture 84, thus bags 61 and 62 can be snapped into place in an aperture 84 and firmly held there.

A stiffening member 92 comprises a metallic ring 95 to which a plurality of rods 93 are fastened, with the rods extending downwardly to form a cage-like structure that fits into and distends the filter bags 61, 62. The ring 95 at the top of the stiffening member rests on the upper surface of the tube support sheet 81. Thus stiffening member 92, when in place within the filter bag, prevents the bag from collapsing during operation.

As shown in FIG. 3, housings 57 and 58 have covers 65 which are hingedly attached to the housings so as to be openable as indicated by the arrows. This configuration provides convenient access to the upper portion of the interiors of the housings for bag replacement. Usually, when it is desired to replace the filter bags, the covers are opened and the bags are saturated with water to prevent any hazardous dried material, such as asbestos particles, from bellowing out of the filter bags into the atmosphere as the bags are disconnected. The saturated depleted filter bags can then be disconnected from their supporting apertures by removing the stiffening member 92 (which is relatively clean) from the top, collapsing the collar 87 by hand and allowing the bag to drop to the bottom of the housing where they can be removed through doors 69 and 71 and bagged along with the accumulated asbestos. Removing the bags from the bottoms of the housings is far superior to removing them from the top because with the later method, the refuse clinging to the outside of the bag tends to contaminate the "clean" area of the upper housing. This dirt can be accidentally sucked into the close tolerances of the positive displacement pump damaging the pump or be emitted through the pump silencer becoming a nuisance or environmental hazard. Removal from the bottom of the housing eliminates this risk.

Figure 6:
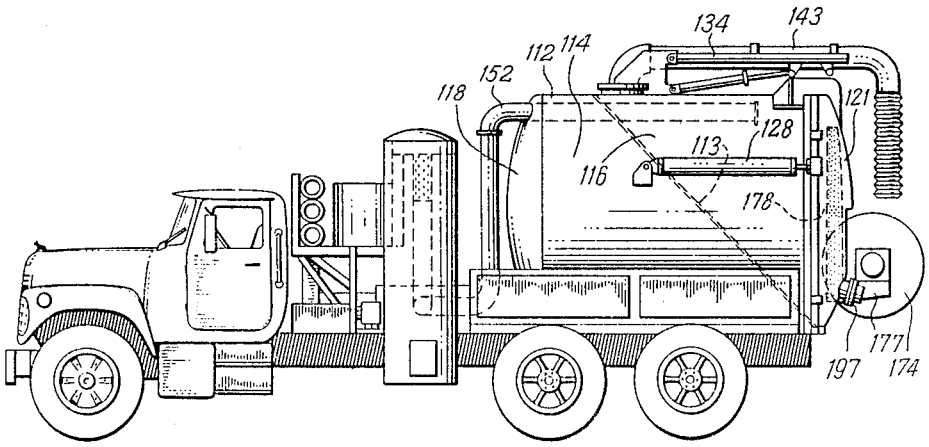
FIG. 6 is a side elevation of a second embodiment of the invention, with the reel and hose mounted in a recess of the rear clamshell closure, and the suction conduit extending to the rear of the vehicle.
Figure 7:
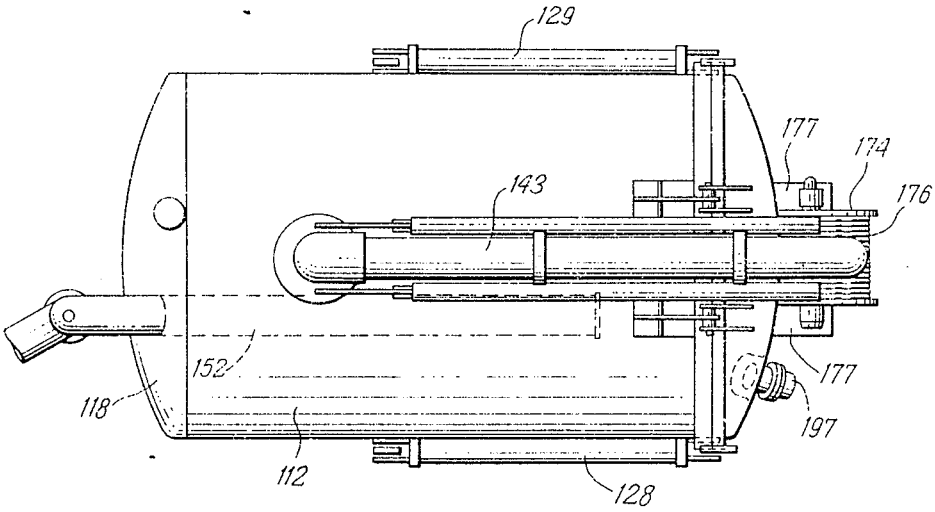
FIG. 7 is a partial plan view of the vehicle of FIG. 6.

FIGS. 6 and 7 illustrate a modified embodiment of the invention whereby the boom and suction hose are directed to the rear of the vehicle and the water hose and reel are mounted to the rear closure of the tank. Boom 134 is mounted to the top of the tank 112, with suction hose 143 being mounted to boom 134. As with FIG. 1, the suction hose 143 communicates at one of its ends with the refuse collection chamber 116, and the other distal end projects beyond the boom 134.

Water hose 176 is collected on water hose reel 174 with the reel being supported by support 177 mounted to the rear clamshell closure 121 of the tank 112. The reel 174 projects into a recess formed in the clamshell closure 121. When the closure 121 is pivoted upwardly by the action of hydraulic cylinders 128 and 129, the reel 174 is moved in unison with the clamshell closure 121 so that it is out of the way during the dumping function of the vehicle.

Exhaust conduit 152 has one of its ends located interiorly of the waste collection chamber 116, and in this embodiment, the conduit extends through the divider wall 113, passes through the upper portion of water chamber 114, out through the clamshell end closure 118, turns downwardly and then forwardly for connection to the filter bag house, as described with respect to FIGS. 1-5.

Figure 8:
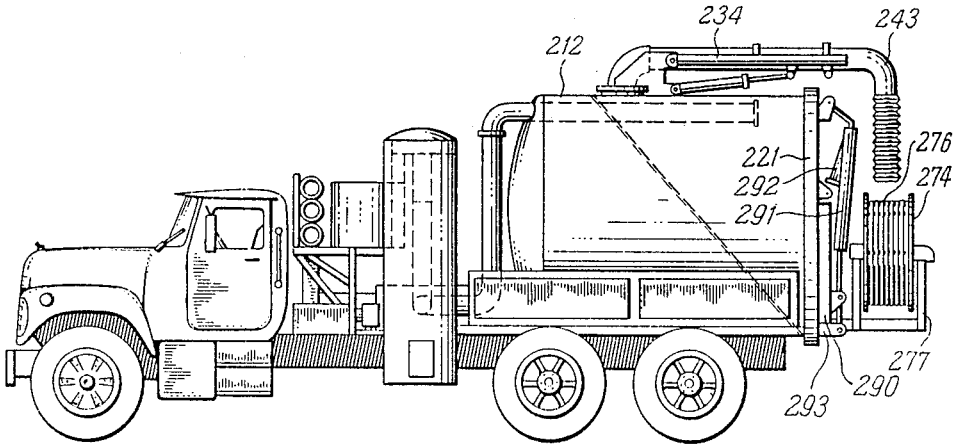
FIG. 8 is a side elevation of a third embodiment of the invention, with the hose mounted on a reel having its axis of rotation extending along the length of the vehicle.
Figure 9:
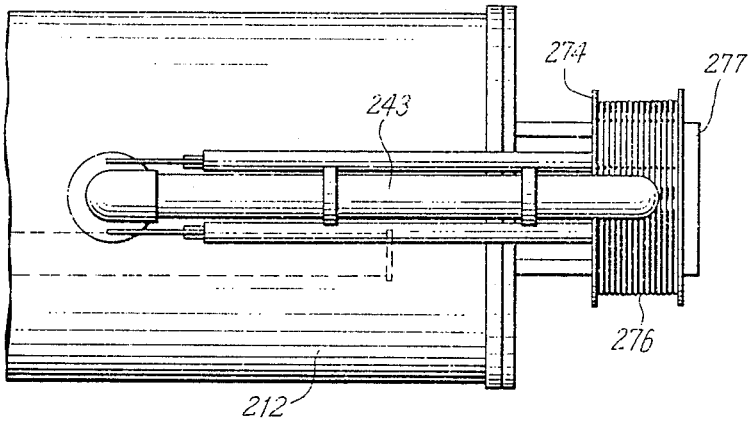
FIG. 9 is a partial plan view of FIG. 8.

FIGS. 8 and 9 show another embodiment of the invention, whereby hose reel 274 and its water supply hose 276 are mounted to the rear closure of the vehicle. The reel is held at a right angle orientation, with the axis of rotation of reel extending lengthwise of the vehicle. The reel is rotatably mounted on its support 277 to the rear member 221 of the tank 212. The suction conduit 243 and boom 234 are substantially the same in construction and operation as described in FIGS. 6 and 7.

Also shown in FIG. 8 is a hingedly attached clamshell panel 290 that covers a correspondingly shaped opening in the rear member 221. A beam 291 is attached at one end to the panel 290 and at its other end to the top portion of the rear member 221. A hydraulic cylinder 292 is mounted to push the beam 291 upwardly with its upper attachment pivoting upon expansion of the cylinder to cause the panel 290 to open up such that collected material within the chamber can be dumped. A locking mechanism 293 is constructed to lock the panel 290 securely in its closed position during operation of the system such that material within the chamber does not accidentally leak or the panel accidentally open.

In some instances the hood of the engine compartment of the vehicle tilts forwardly when the hood is to be opened. If the reel and water hose are mounted to the front of the vehicle as illustrated in FIGS. 1 and 2, it is difficult to open the hood while the reel is in its proper location, and the reel might have to be tilted or dismounted from the vehicle in order to tilt the hood forwardly. Also, when the engine of the vehicle is in operation, the forwardly mounted hose and reel and related apparatus tends to interfere with the flow of air through the radiator of the vehicle. Thus, a larger capacity radiator might be necessary for proper operation of the vehicle.

In order to avoid the problems mentioned above, the mounting of the reel and its hose to the rear of the vehicle as illustrated in FIGS. 6-9 can be provided at the request of the customer.

Figure 10:
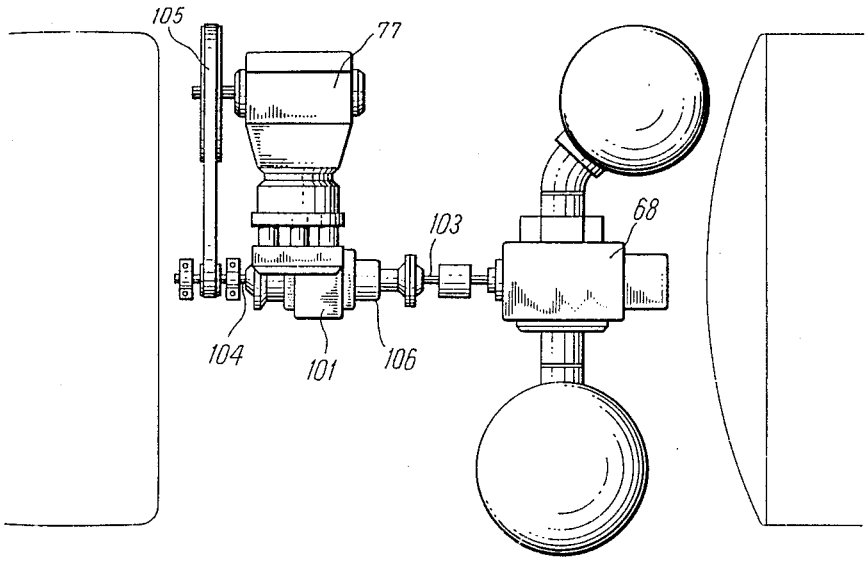
FIGS. 10 and 11 are a schematic diagram of the power take-off system that drives the air pump and water pump from the vehicle engine.
Figure 11:
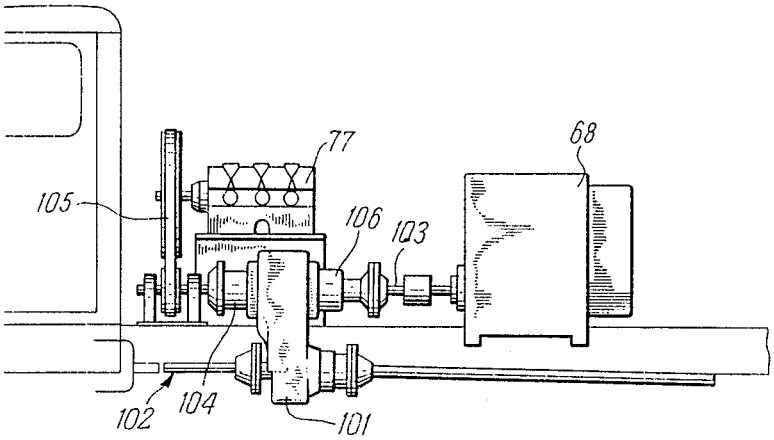

As illustrated schematically in FIGS. 10 and 11, the power take-off system for the components of the vacuum collector system derive their power from the vehicle engine. As illustrated in FIG. 11, a transfer case 101 is mounted in driving relationship with respect to the drive shaft 102 of the vehicle, and rotates its output shafts through clutches 104 and 106. Clutch 106 operates air pump or blower 68. Clutch 104 operates water pump 77 through the belt and sheave connection 105.

OPERATION

In operation, the vehicle 10 is driven to the cleanup site, for example, a clogged sewer, with compartment 14 filled with water and compartment 16 empty. At the site, the hose 76 equipped with a suitable nozzle and the duct 43 are lowered into the sewer and the water pump 77 and air pump 68 are started. The nozzle and hose are pulled into the sewer by recoil of the rear firing jets of the water existing the nozzle. As the high pressure water liquefies or loosens the material in the sewer the material is sucked up and carried through duct 43 and discharged at high velocity into chamber 16. The material thus discharged passes through the cyclone ring 49 so that the heavier material tends to fall downwardly in the refuse collection chamber, and the air is drawn from the chamber 16 through duct 52 and passed to the bag housings 57 and 58 where it is filtered, as explained heretofore. As refuse collection chamber 16 is filled with the waste matter which contains a large amount of water, some of the water can be drawn off through a perforated standpipe 96 which communicates with the exterior of tank 12 through a suitable valve 97, 197 when the pressure in the refuse collection chamber 16 is at atmospheric pressure. The perforations in standpipe 96 are small enough to prevent most solid matter from passing therethrough, but large enough to permit water to pass.

The level detector 70 in bag house 57 senses the level of refuse in the lower portions of the bag house and operates to terminate the suction function of the system, either by disengaging the clutch 106 of the air pump or by opening a bypass valve (not shown). The levels of waste in the lower portion of the bag houses generally correspond to the level of refuse in collection chamber 16, so that the detector switches provide a safe and inexpensive shut down system.

After the clean-up process is completed, refuse collection chamber 16 is substantially full, and compartment 14 is substantially empty. Thus there is a shift of weight toward the rear of the vehicle. However, because of the slope of internal wall 13, the actual center of gravity shifts enough to reduce the loading on the front axle thus increasing the overall machine legal load carrying capacity as it relates to state and federal law including the bridge laws.

While the operation has been explained in connection with wet cleaning, the vehicle 10 can be used for cleaning up dry materials as well. In addition, the distal end of vacuum duct 43 can be fitted with an integral hydraulically driven sludge pump as previously described for cleaning out sludge deposits, ponds, and the like.

When the vehicle is driven to a dump site, the rear clamshell end wall 23 is tilted up on hinges 24 or 26 and the collection of waste material in the concave space of the clamshell end wall falls from the clamshell end wall and the waste material inside the compartment 16 slides down the sloped divider wall 13 and falls out the rear of the compartment 16. With this arrangement the tank 12 does not have to be tilted to dump the collected waste material.

The foregoing illustrates the principles of the invention in a preferred embodiment thereof. Numerous modifications or changes may occur to workers in the art without departure from the spirit and scope of the invention.

We claim:

1. In a vacuum refuse collecting vehicle for cleaning waste containing chambers and which includes a vehicle chassis, a water injection system including means for delivering water under pressure to the chamber and a vacuum waste collection system including a duct for insertion into the chamber and an air pump for creating a vacuum within the duct, the improvement comprising:

a tank for containing water for the water delivery system and for receiving waste material from the duct, said tank fixedly mounted on the chassis, said tank including first and second ends, closure means for said first end, movable closure means for said second end, said movable closure means being hingedly attached to said tank and adapted to be swung upwardly to open said tank at the said second end thereof, sloped wall means within said tank for dividing said tank into first and second containment chambers sealed from each other and extending from adjacent the top of said first end to adjacent the bottom of said second end at said movable closure means, and spacer members insertable between the ends of said tank and said closure means for increasing the capacity of said containment chambers.

2. The improvement as claimed in claim 1 wherein said septum slopes downwardly at an angle of at least 37° extending from the top front of said tank to the rear bottom thereof.

3. The improvement as claimed in claim 1 wherein said septum is made of a material taken from a group including stainless steel and mild steel.

4. The improvement as claimed in claim 1 and further including a hose reel mounted on the exterior of said movable closure means, said hose reel being adapted to carry a hose wound thereon.

5. The improvement as claimed in claim 4, wherein said hose is connected to said first containment chamber through a pump means.

6. The improvement as claimed in claim 5 and further including means within said second containment chamber for separating liquid waste material from solid waste material.

7. The improvement as claimed in claim 6 wherein said means for separating comprises a perforated standpipe mounted to said movable closure means at said end of said tank.

8. The improvement as claimed in claim 4 and further comprising a second duct having an open end within said second chamber, said second duct being connected to the air pump, whereby a vacuum is created within said second containment chamber.

9. The improvement as claimed in claim 8 and further including filter means for cleaning the air said second duct, said filter means comprising a housing containing filter elements located between said second duct and the air pump.

10. The improvement as claimed in claim 1 wherein the duct for insertion into the waste containing chamber terminates in an open end within said second containment chamber.

11. In a vacuum refuse collecting vehicle for cleaning waste containing chambers and the like and which includes a wheel supported vehicle chassis for moving in a forward direction, a water injection system including means for delivering water under pressure to the chamber and a vacuum waste collection system including a duct for insertion into the chamber and an air pump for creating a vacuum within the duct, the improvement comprising:

a tank fixedly mounted on the chassis and defining a discharge opening facing rearwardly of said chassis, movable closure means for closing said discharge opening, said movable closure means being hingedly attached at its upper portion to said tank and adapted to be swung upwardly to open said tank at said discharge opening, sloped wall means within said tank with the lower end of said sloped wall means positioned adjacent said discharge opening for dividing said tank into a forward water containment chamber and a rearward waste containment chamber sealed from each other for containing water for the water injection system and for receiving waste material from the duct, and a spacer member affixed to said movable closure means between said discharge opening of said tank and said closure means for increasing the capacity of said rearward waste containment chamber and for swinging upwardly away from said discharge opening with said movable closure means to a downwardly facing altitude, whereby when the movable closure means is open the waste collected in the rearward waste containment chamber is free to move down the sloped wall means and through the discharge opening and the waste collected in the spacer member is free to fall from said spacer member.

12. The improvement as claimed in claim 11, wherein said sloped wall means comprises a septum extending at a downwardly sloping angle of at least 37°.

13. The improvement as claimed in claim 11 wherein said sloped wall means is made of a material taken from a group including stainless steel and mild steel.

14. The improvement as claimed in claim 11 and further including a hose reel mounted on the exterior of said movable closure means, said hose reel being adapted to carry a hose wound thereon.

15. The improvement as claimed in claim 14 and further including pump means for moving water from said forward water containment chamber through said hose.

16. The improvement as claimed in claim 15 and further including means within said rearward waste containment chamber for separating liquid waste material from solid waste material.

17. The improvement as claimed in claim 16 wherein said means for separating liquid waste material from solid waste material comprises a perforated stand pipe mounted to said movable closure means.

18. The improvement as claimed in claim 11 wherein the duct for insertion into the waste containing chamber terminates in an open end within said rearward waste containment chamber.

19. The improvement as claimed in claim 11 and further including a second duct having an open end within said rearward waste containment chamber for connection to the air pump for creating a vacuum in said rearward waste containment chamber.

20. The improvement as claimed in claim 19 and further including filter means for filtering the air moved from said second duct, said filter means comprising a housing containing filter elements located between said second duct and the air pump.

21. The improvement as claimed in claim 11 and wherein said tank is cylindrical, and wherein said spacer member is of compatible size and shape to said tank for sealing against the discharge opening of said tank.

* * * * *